US009209584B2

(12) United States Patent
Myer et al.

(10) Patent No.: US 9,209,584 B2
(45) Date of Patent: Dec. 8, 2015

(54) ELECTRICAL CONNECTOR ASSEMBLY

(71) Applicant: Tyco Electronics Corporation, Berwyn, PA (US)

(72) Inventors: John Mark Myer, Millersville, PA (US); Hurley Chester Moll, Hershey, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/201,390

(22) Filed: Mar. 7, 2014

(65) Prior Publication Data

US 2015/0255939 A1 Sep. 10, 2015

(51) Int. Cl.
*H01R 12/00* (2006.01)
*H01R 31/06* (2006.01)

(52) U.S. Cl.
CPC ..... *H01R 31/06* (2013.01)

(58) Field of Classification Search
CPC .... H01R 13/514; H01R 13/405; H01R 13/42; H01R 24/66; H01R 31/06; H01R 13/516
USPC ..... 439/655
See application file for complete search history.

(56) References Cited

U.S. PATENT DOCUMENTS 5,454,737 A * 10/1995 Saba ..... 439/655
5,542,856 A * 8/1996 Wood ..... 439/281
5,616,034 A * 4/1997 Masuda et al. ..... 439/78
5,911,600 A * 6/1999 Mosquera ..... 439/655
6,364,713 B1 * 4/2002 Kuo ..... 439/638
6,394,849 B2 * 5/2002 Kasai ..... 439/655
7,048,569 B2 * 5/2006 Shimizu ..... 439/354
7,048,570 B2 * 5/2006 Kubo et al. ..... 439/357
7,094,109 B2 * 8/2006 Chou ..... 439/651
7,128,616 B1 * 10/2006 Orr et al. ..... 439/651
7,168,989 B2 * 1/2007 Faulkner ..... 439/620.22
2002/0076995 A1 6/2002 Kurimoto et al.
2004/0132349 A1 7/2004 Sakurai et al.
2005/0106945 A1 * 5/2005 Suzuki et al. ..... 439/655

FOREIGN PATENT DOCUMENTS

JP 2013 004257 A 1/2013
WO 2009/120283 A2 10/2009

OTHER PUBLICATIONS

International Search Report, International Application No. PCT/US2015/018420, International Filing Date, Mar. 3, 2015.

* cited by examiner

*Primary Examiner* — Jean F Duverne

(57) ABSTRACT

An electrical connector assembly includes a header having a body having a first receptacle and a second receptacle separated by a midwall and a plurality of contacts held by the midwall. The contacts have first pins located within the first receptacle and second pins located within the second receptacle. A first plug is received in the first receptacle. The first plug includes a housing holding a plurality of terminals terminated to corresponding wires having sockets mated with corresponding first pins in the first receptacle. The sockets are configured to be electrically connected to sockets of a second plug received in the second receptacle by the contacts held by the header.

19 Claims, 5 Drawing Sheets

ELECTRICAL CONNECTOR ASSEMBLY

BACKGROUND OF THE INVENTION

The subject matter herein relates generally to electrical connector assemblies.

It is common in electrical connector technology to provide a plurality of wires for example in a harness configuration, attached to a first connector, and another plurality of wires attached to another harness in yet another complementary secondary connector. The first connector typically includes pin terminals while the second connector typically includes receptacle or socket terminals. Multiple considerations need to be considered in designing and manufacturing such terminals, particularly when the application to which the connectors will be subjected to, is considered.

For example, in the automotive field, when electrical connectors are required in a plurality of harness connections, the pins and receptacles are subjected to multiple adverse conditions. First, vibration from the engine or road conditions sometimes provides degradation to the pin and socket connection. Due to the inclement weather conditions in which the automobile needs to operate, most automotive connectors are also sealed, which prevents water, salt water or other contaminants from encroaching into the connector housing and degrading the electrical connection between the pins and receptacles. Thus for the sealing purposes, it is desirable to have the terminals be easily insertable through a seal member or a planar seal which seals the back of the electrical connector.

As the overall size of the connectors decreases and/or the desired density of the terminals increases, the terminals are being manufactured smaller and smaller. The robustness of terminals is problematic, particularly for the pins which are fragile and susceptible to damage during assembly and mating.

A need remains for a robust electrical connector assembly for electrically connecting two wire harnesses.

BRIEF DESCRIPTION OF THE INVENTION

In one embodiment, an electrical connector assembly is provided including a header comprising a body having a first receptacle and a second receptacle separated by a midwall and a plurality of contacts held by the midwall. The contacts have first pins located within the first receptacle and second pins located within the second receptacle. A first plug is received in the first receptacle. The first plug includes a housing holding a plurality of terminals terminated to corresponding wires having sockets mated with corresponding first pins in the first receptacle. The sockets are configured to be electrically connected to sockets of a second plug received in the second receptacle by the contacts held by the header.

Optionally, the header and contacts may allow the first plug and corresponding sockets to mate with the second plug and corresponding sockets. The contacts may have first and second mating interfaces both arranged interior of the body of the header for mating with the sockets and second sockets, respectively.

Optionally, the header may include a first end and a second end. The first end may be open to the first receptacle and the first plug may be loaded into the first receptacle through the first end. The second end may be open to the second receptacle and the second plug may be loaded into the second receptacle through the second end.

Optionally, the header may have a first mating interface defined by the body and first pins and a second mating interface defined by the body and second pins. The first and second mating interfaces may be identical.

Optionally, the first plug may have an independent secondary lock and peripheral seal coupled to a mating end of the housing. The independent secondary lock may have at least one finger engaging the terminals to hold the terminals in the housing. The peripheral seal may engage the body to seal the first plug within the first receptacle.

Optionally, the housing may include an inner housings and an outer housing. The outer housing may surround at least part of the inner housing. The outer housing may be removably latched to the header. The outer housing may be positioned rearward of the peripheral seal. The body may define a header envelope having a height and a width. The outer housing may be contained within the header envelope.

Optionally, the electrical connector assembly may include a second plug. The second plug may include an inner housing holding a plurality of second terminals terminated to corresponding wires. The second terminals may have sockets configured to be mated with corresponding second pins in the second receptacle. The second plug may include an independent secondary lock and peripheral seal coupled to a mating end of the inner housing of the second plug. The second plug may include an outer housing surrounding at least part of the inner housing. The outer housing may be removably latched to the header. The inner housing of the second plug may be identical to the inner housing of the first plug. The outer housing of the second plug may include a shroud covering the periphery of the second plug. The shroud may extend along an exterior of the body of the header. The outer housing of the first plug may be un-shrouded.

In another embodiment, an electrical connector assembly is provided that includes a header comprising a body having a first receptacle and a second receptacle separated by a midwall. The header has a first latch extending from the body and a second latch extending from the body. Multiple contacts are held by the midwall. The contacts have first pins in the first receptacle and second pins in the second receptacle. A first plug is received in the first receptacle. The first plug includes a first housing holding a plurality of terminals terminated to corresponding wires. The terminals have sockets mated with corresponding first pins in the first receptacle. The first housing is coupled to the header and is removably secured to the header by the first latch. A second plug is received in the second receptacle. The second plug includes a second housing holding a plurality of terminals terminated to corresponding wires. The terminals have sockets mated with corresponding second pins in the second receptacle. The second housing is coupled to the header and removably secured to the header by the second latch.

DETAILED DESCRIPTION OF THE INVENTION

Figure 1:
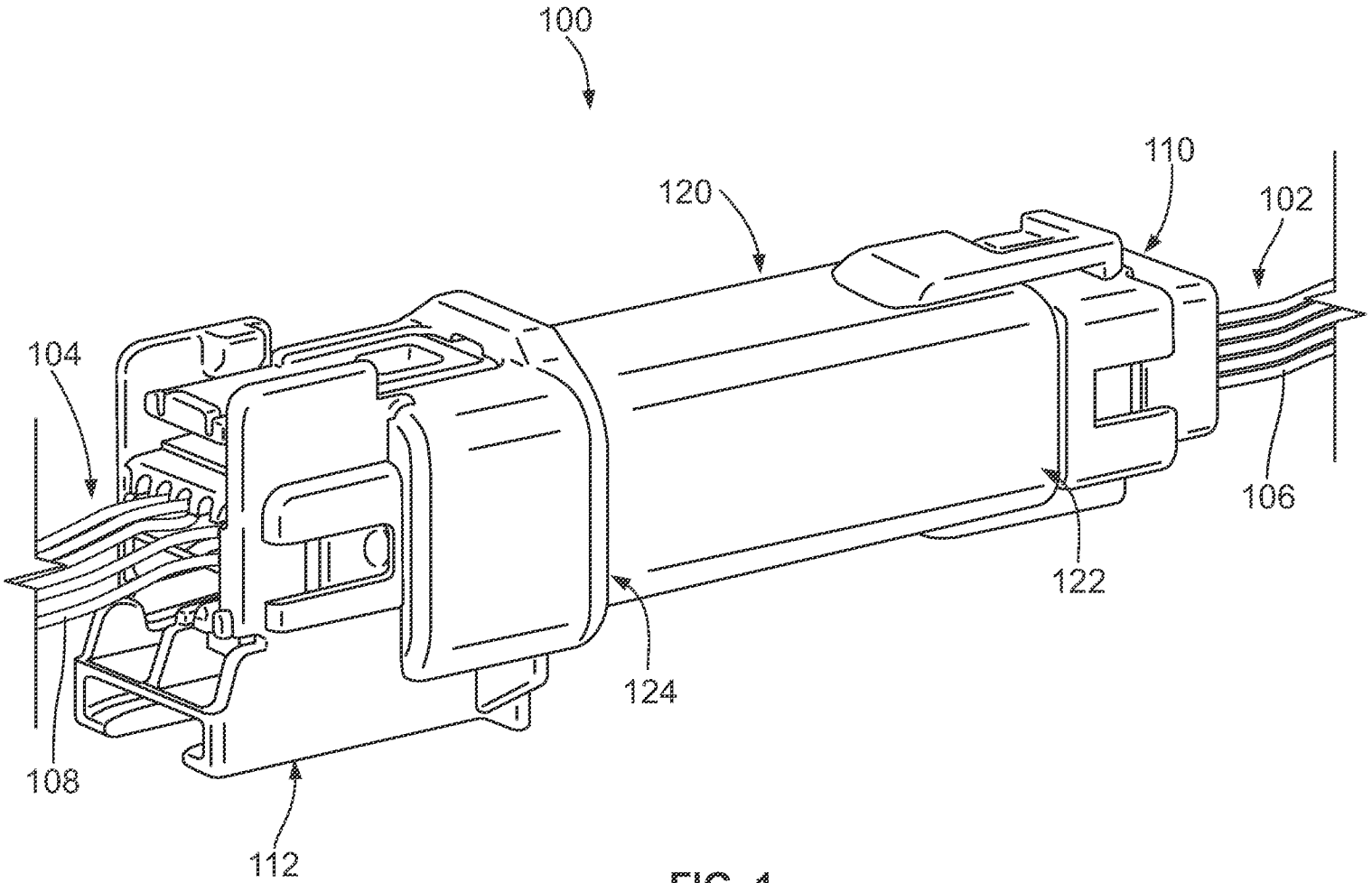
FIG. 1 illustrates an electrical connector assembly formed in accordance with an exemplary embodiment.

FIG. 1 illustrates an electrical connector assembly 100 formed in accordance with an exemplary embodiment. The electrical connector assembly 100 is used to interconnect a first wire harness 102 and a second wire harness 104. The wire harnesses 102, 104 have a plurality of wires 106, 108, respectively. A first electrical connector 110 is terminated to the ends of the wires 106 of the first wire harness 102. A second electrical connector 112 is terminated to the ends of the wires 108 of the second wire harness 104.

The electrical connector assembly 100 includes a header 120 used to mechanically and electrically interconnect the first and second electrical connectors 110, 112. A portion of the first electrical connector 110 is plugged into a first end 122 of the header 120 and a portion of the second electrical connector 112 is plugged into a second end 124 of the header 120. Because a portion of the first electrical connector 110 is plugged into the header 120, the first electrical connector 110 may be referred to hereinafter as a first plug 110. Because a portion of the second electrical connector 112 is plugged into the header 120, the second electrical connector 112 may be referred to hereinafter as a second plug 112. The first plug 110, header 120 and second plug 112 of the electrical connector assembly 100 are used to electrically connect the first wire harness 102 and the second wire harness 104.

Optionally, the outer profiles of the first and second plugs 110, 112 may be different from one another (for example, the second plug 112 extends around an exterior of the second end 124 of the header 120). Optionally, at least some of the internal components of the first and second plugs 110, 112 may be identical and used in both the first and second plugs 110, 112 to reduce the total number of parts needed to manufacture the electrical connector assembly 100. Having the first plug 110 smaller than the second plug 112 allows the electrical connector assembly 100 to be assembled more easily. For example, the header 120 and first plug 110 may be preassembled and routed or fished into position within the device or vehicle in which the electrical connector assembly 100 is used. For example, the smaller profile of the header 120 and first plug 110 allow the header 120 and first plug 110 to be fished through openings or into spaces that would be more difficult or impossible if the second plug 112 were coupled to the header 120. The second plug 112 may be mated to the header 120 after the header 120 and first plug 110 are positioned within the device or vehicle.

Figure 2:
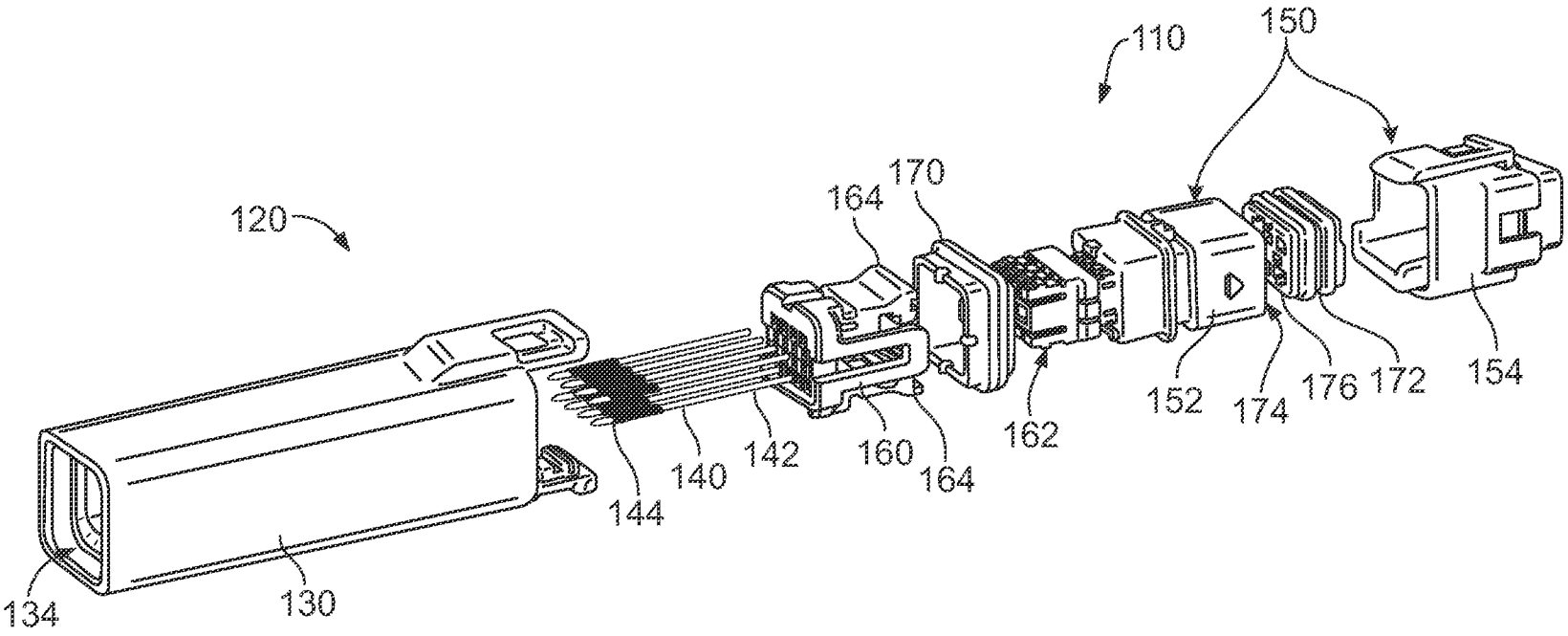
FIG. 2 is an exploded view of a portion of the electrical connector assembly showing a header and a first plug thereof.

FIG. 2 is an exploded view of a portion of the electrical connector assembly 100 showing the header 120 and the first plug 110. The header 120 includes a body 130 extending between the first and second ends 122, 124. The body 130 defines a first receptacle 132 (shown in FIG. 3) at the first end 122 and a second receptacle 134 at the second end 124. The first and second receptacles 132, 134 are separated by a midwall 136 (shown in FIG. 4).

The header 120 includes a plurality of contacts 140 configured to be held by the midwall 136 within the interior of the body 130. The contacts 140 have first pins 142 at one end of the contacts 140 and second pins 144 at the other end of the contacts 140. The first pins 142 are configured to be held in the first receptacle 132. The second pins 144 are configured to be held in the second receptacle 134. The contacts 140 are used to electrically connect the first plug 110 with the second plug 112 (shown in FIG. 1).

The first plug 110 includes a housing 150. In an exemplary embodiment, the housing 150 is a two piece housing defined by an inner housing 152 and an outer housing 154. The outer housing 154 is configured to be coupled to the inner housing 152 to define the housing 150. In alternative embodiments, the housing 150 may be a single piece housing.

The housing 150 is used to hold a plurality of terminals 156 (shown in FIG. 5), which are configured to be terminated to corresponding wires 106 (shown in FIG. 1) of the first wire harness 102 (shown in FIG. 1). In an exemplary embodiment, the first plug 110 includes an independent secondary lock (ISL) 160. The ISL 160 is configured to be coupled to the inner housing 152 at a mating end 162 of the inner housing 152. The ISL 160 is used to lock the terminals 156 in the inner housing 152. In an exemplary embodiment, the ISL 160 includes fingers 164 that are used to lock the terminals 156 in the housing 150 (see FIG. 5). The fingers 164 may define terminal position assurance (TPA) devices that assure that the terminals 156 are fully loaded into the inner housing 152. For example, if the terminals 156 are not fully loaded into the inner housing 152, the fingers 164 may be unable to move to a closed or a locked position. Optionally, if the fingers 164 are not in the closed or locked position, the first plug 110 may be unable to be loaded into the first receptacle 132. As such, during assembly, if the installer is unable to plug the first plug 110 into the header 120, such as when the fingers 164 are open due to the one or more terminals 156 blocking the fingers 164, the installer will reassemble the first plug 110 ensuring that the terminals 156 are fully loaded to allow the fingers 164 to lock behind the terminals 156.

In an exemplary embodiment, the first plug 110 includes a peripheral seal 170 configured to be coupled to the mating end 162 of the inner housing 152. The peripheral seal 170 extends around the exterior of the inner housing 152. The peripheral seal 170 is received in and engages an inner surface of the body 130 to seal the first plug 110 within the first receptacle 132.

In an exemplary embodiment, the first plug 110 includes a wire seal 172 that is configured to be coupled to a terminating end 174 of the inner housing 152. The terminating end 174 is provided at the rear of the inner housing 152. The wire seal 172 may be received within the inner housing 152. Alternatively, the wire seal 172 may be provided rearward of the inner housing 152. Optionally, the wires seal 172 may be provided interior of the outer housing 154. The wire seal 172 includes a plurality of openings 176 therethrough. The wires 106 (shown in FIG. 1) and corresponding terminals 156 (shown in FIG. 5) are loaded through corresponding openings 176. The wire seal 172 seals against the corresponding wires 106 to prevent moisture or contaminates from ingress into the interior of the inner housing 154. Optionally, an exterior of the wire seal 172 may seal against the inner housing 152 to prevent ingress of moisture or contaminates into the inner housing 152.

Figure 3:
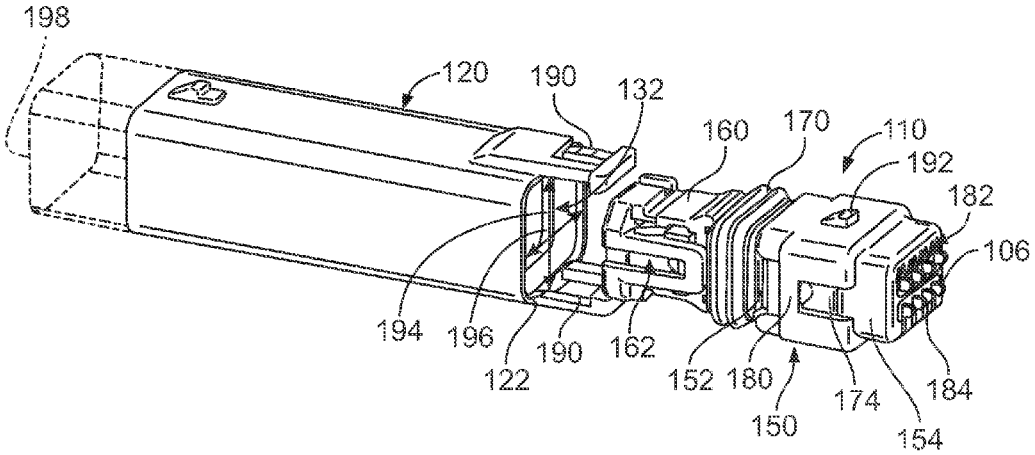
FIG. 3 illustrates a portion of the electrical connector assembly showing the first plug in an assembled state and poised for loading into the header.

FIG. 3 illustrates a portion of the electrical connector assembly showing the first plug 110 in an assembled state and poised for loading into the first receptacle 132 of the header 120. When assembled, the peripheral seal 170 is coupled to the mating end 162 of the housing 150, and the ISL 160 is coupled to the mating end 162 of the housing 150. The outer housing 154 is coupled to the terminating end 174 of the inner housing 152. In an exemplary embodiment, the outer housing 154 includes latches 180 that engage corresponding tabs on the inner housing 152 to secure the outer housing 154 to the inner housing 152. The outer housing 154 includes openings 182 through a rear 184 of the outer housing 154. The wires 106 extend through corresponding openings 182. The outer housing 154 may hold the wire seal 172 (shown in FIG. 2) at the rear 184.

The header 120 includes latches 190 extending from the first end 122. The latches 190 are used to secure the first plug 110 within the header 120. For example, the latches 190 engage corresponding catches 192 extending from the outer housing 154. The latches 190 are deflectable and may be released to remove the first plug 110 from the header 120.

In an exemplary embodiment, an outer profile of the first plug 110 is similar to an outer profile of the header 120 such that the first plug 110 does not significantly, detrimentally affect the overall size of the electrical connector assembly 100. For example, at the first end 122, the header 120 has a height 194 and a width 196 defining a header envelope 198. The height and width of the first plug 110 may be substantially similar to the height 194 and width 196 of the header 120. Optionally, the first plug 110 may be contained within the header envelop 198. For example, the first plug 110 has a height that is less than or equal to the height 194 and a width that is less than or equal to the width 196. As such, when the first plug 110 is coupled to the header 120 the sub-assembly of the first plug 110 and header 120 may be routed through openings or in spaces sized to accommodate the header envelope 198 (the header envelope 198 may accommodate the latches 190 of the header 120).

Figure 4:
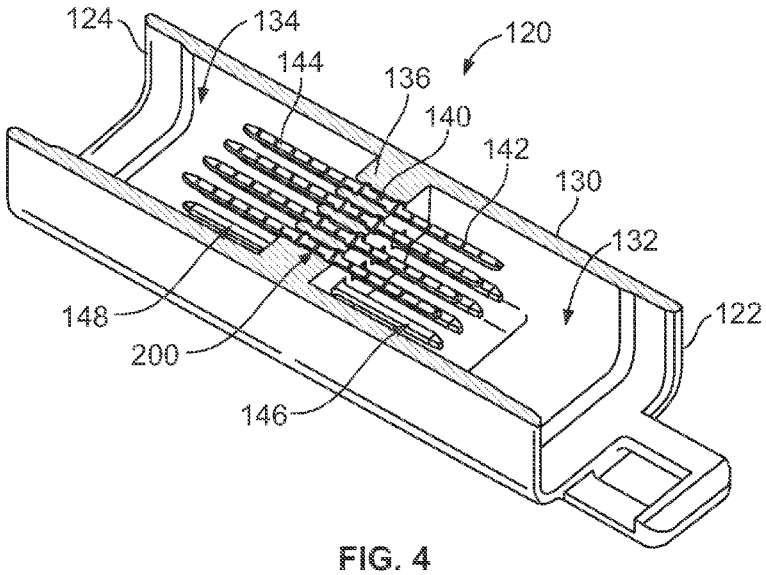
FIG. 4 is a sectional view of the header.

FIG. 4 is a sectional view of the header 120. FIG. 4 illustrates the contacts 140 held by the midwall 136 of the header 120. The midwall 136 includes channels 200 extending therethrough. The contacts 140 are loaded into the channels 200. The contacts 140 include barbs extending therefrom that dig into the midwall 136 to secure the contacts 140 in the channels 200. The first pins 142 extend from the midwall 136 into the first receptacle 132. The second pins 144 extend from the midwall 136 into the second receptacle 134. The first pins 142 are poised for mating with the first plug 110 (shown in FIG. 1). The second pins 144 are poised for mating with the second plug 112 (shown in FIG. 1).

The header 120 includes a first mating interface 146 defined by the body 130 and first pins 142 and a second mating interface 148 defined by the body 130 and second pins 144. The mating interfaces 146, 148 are defined by the size and shape of the receptacles 132, 134 as well as the positions of the pins 142, 144 in the receptacles 132, 134. The mating interfaces 146, 148 are defined by the size and shape of the body 130 and features used to interact with and/or secure the plugs 110, 112 in the receptacles 132, 134. Optionally, the first and second mating interfaces 146, 148 may be identical.

The contacts 140 are used to electrically connect the first plug 110 coupled to the first end 122 of the header 120 with the second plug 112 coupled to the second end 124 of the header 120. The double pin contacts 140 eliminate the need for either the first electrical connector 110 or the second electrical connector 112 to include pins. The double pin contacts 140 allow the first and second plugs 110, 112 to both include socketed terminals. As such, both the first plug 110 and the second plug 112 may be female plugs.

Figure 5:
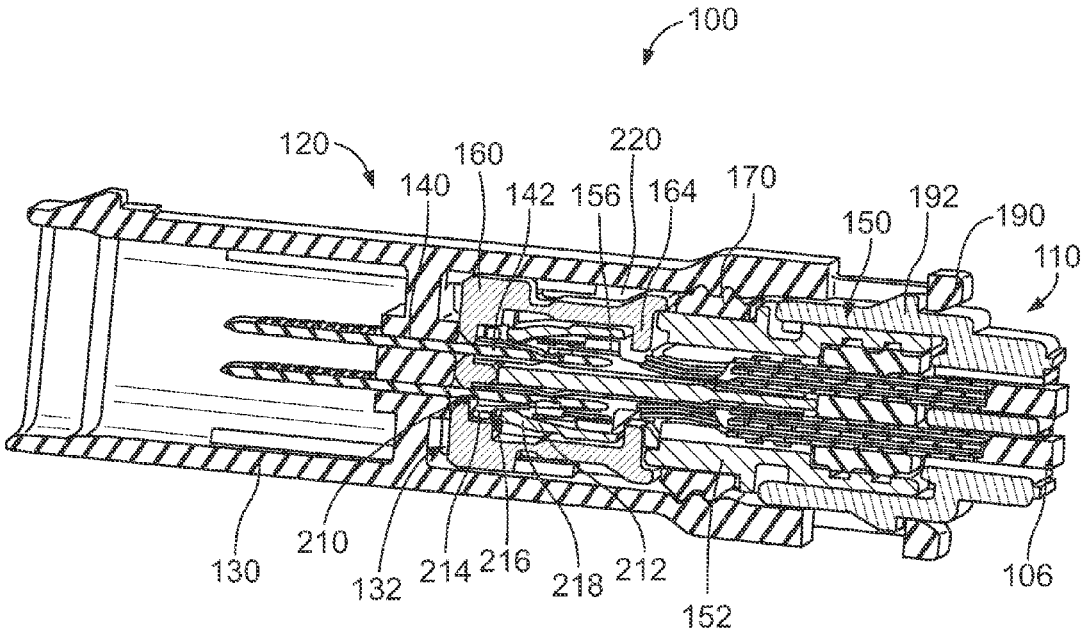
FIG. 5 is a cross sectional view of a portion of the electrical connector assembly showing a sub-assembly including the header and first plug.

FIG. 5 is a cross sectional view of a portion of the electrical connector assembly 100 showing a sub-assembly including the header 120 and first plug 110. FIG. 5 illustrates the terminals 156 of the first plug 110 held within the inner housing 152. The terminals 156 are terminated to ends of corresponding wires 106. For example the terminals 156 may be crimped to the corresponding wires 106. The terminals 156 include sockets 210 at mating ends of such terminals 156. The sockets 210 receive corresponding first pins 142 of corresponding contacts 140. Optionally, the terminals 156 may be box-shaped terminals defining the sockets 210 with deflectable beams 212 that extend into the sockets 210 to electrically connect to the corresponding first pins 142. In an exemplary embodiment, distal ends 214 of the terminals 156 extend forward of the inner housing 152 and into corresponding pockets 216 of the ISL 160. Arms 218 at the front of the inner housing 152 engage the distal ends 214 of the terminal 156 to hold the terminals 156 relative to the housing 150. The fingers 164 of the ISL 160 extend through the inner housing 152 and are positioned behind portions of the terminals 156 to lock the terminals within the housing 150. The arms 218 define a primary lock for the terminals 156 and the fingers 164 define secondary locks for the terminals 156.

When the first plug 110 is loaded into the header 120, the peripheral seal 170 engages an interior surface 220 of the body 130. The peripheral seal 170 seals the first plug 110 within the first receptacle 132. The peripheral seal 170 prevents moisture and contaminates from ingress into the first receptacle 132.

When the first plug 110 is plugged into the header 120, the latches 190 engage the catches 192 to secure the first plug 110 within the first receptacle 132. The first plug 110 is prevented from backing out of the first receptacle 132 by the latches 190. The latches 190 may be deflected outward to allow the first plug 110 to be removed from the first receptacle 132.

Figure 6:
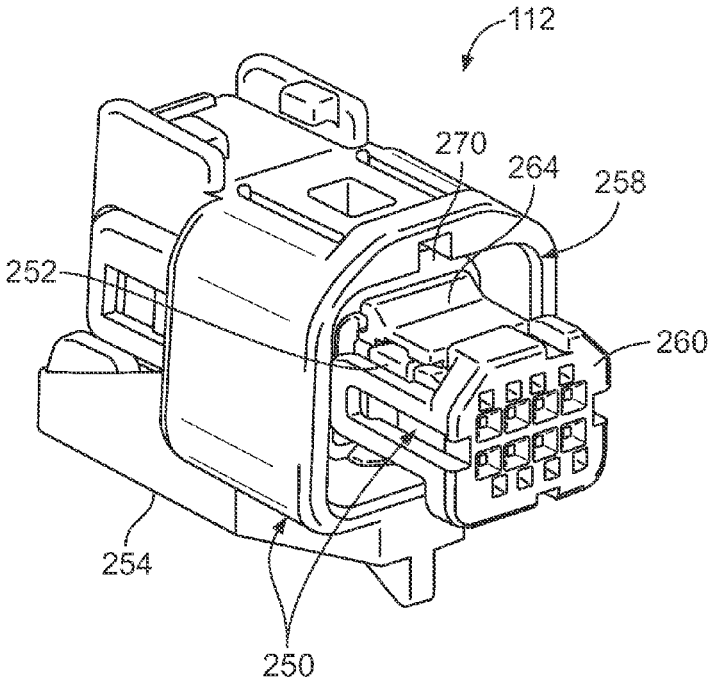
FIG. 6 is a front perspective view of a second plug of the electrical connector assembly formed in accordance with an exemplary embodiment.

FIG. 6 is a front perspective view of the second plug 112 formed in accordance with an exemplary embodiment. The second plug 112 includes a housing 250. In an exemplary embodiment, the housing 250 is a two piece housing defined by an inner housing 252 and an outer housing 254. In an exemplary embodiment, the inner housing 252 is identical to the inner housing 152 (shown in FIG. 2), while the outer housing 254 is different than the outer housing 154 (shown in FIG. 2). For example, the outer housing 254 is shrouded to protect components of the second plug 112 and to fit around the end of the header 120 (shown in FIG. 2), while the outer housing 154 is un-shrouded to fit within the header 120. The outer housing 254 is configured to be coupled to the inner housing 252 to define the housing 250. In alternative embodiments, the housing 250 may be a single piece housing.

The housing 250 is used to hold a plurality of terminals 256 (shown in FIG. 7), which are configured to be terminated to corresponding wires 108 (shown in FIG. 1) of the second wire harness 104 (shown in FIG. 1). In an exemplary embodiment, the second plug 112 includes an independent secondary lock (ISL) 260. Optionally, the ISL 260 is identical to the ISL 160 (shown in FIG. 2). The ISL 260 is configured to be coupled to the inner housing 252 at a mating end of the inner housing 252. The ISL 260 is used to lock the terminals 256 in the inner housing 252. In an exemplary embodiment, the ISL 260 includes fingers 264 that are used to lock the terminals 256 in the housing 250. The fingers 264 may define terminal position assurance (TPA) devices that assure that the terminals 256 are fully loaded into the inner housing 252. For example, if the terminals 256 are not fully loaded into the inner housing 252, the fingers 264 may be unable to move to a closed or a locked position. Optionally, if the fingers 264 are not in the closed or locked position, the second plug 112 may be unable to be loaded into the header 120.

In an exemplary embodiment, the second plug 112 includes a peripheral seal 270 configured to be coupled to the mating end of the inner housing 252. Optionally, the peripheral seal 270 is identical to the peripheral seal 170 (shown in FIG. 2). The peripheral seal 270 extends around the exterior of the inner housing 252. The outer housing 254 surrounds and protects the peripheral seal 270, such as to protect the peripheral seal 270 from damage during shipping, handling, assembly and the like. For example, the outer housing 254 is shrouded and includes a shroud 258 extending around the inner housing 252 and the peripheral seal 270. The shroud 258 of the outer housing 254 protects the peripheral seal 270. The peripheral seal 270 is configured to engage the header 120 to seal the second plug 112 within the header 120.

In an exemplary embodiment, the second plug 112 includes a wire seal 272 (shown in FIG. 7) that is configured to be coupled to a terminating end of the inner housing 252. Optionally, the wire seal 272 is identical to the wire seal 172 (shown in FIG. 2). The wire seal 272 may be received within the inner housing 252. Alternatively, the wire seal 272 may be provided rearward of the inner housing 252. Optionally, the wires seal 272 may be provided interior of the outer housing 254. The wires 108 (shown in FIG. 1) and corresponding terminals 256 (shown in FIG. 7) are loaded through the wire seal 272. The wire seal 272 seals against the corresponding wires 108 to prevent moisture or contaminates from ingress into the interior of the inner housing 254. Optionally, an exterior of the wire seal 272 may seal against the inner housing 252 to prevent ingress of moisture or contaminates into the inner housing 252.

Figure 7:
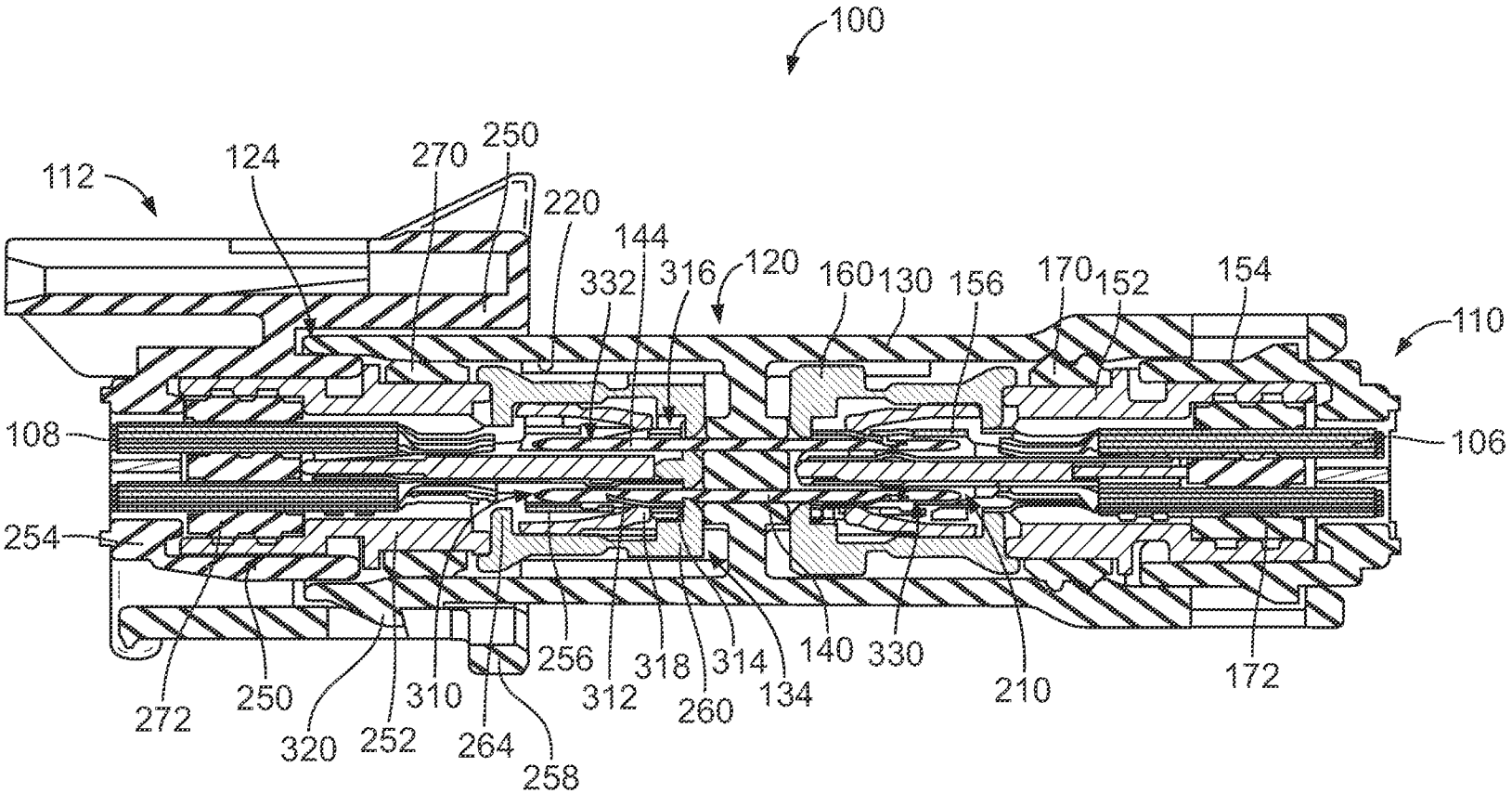
FIG. 7 is a cross sectional view of the electrical connector assembly showing the first and second plugs mated with the header.

FIG. 7 is a cross sectional view of the electrical connector assembly 100 showing the first and second plugs 110, 112 mated with the header 120. FIG. 7 illustrates the terminals 256 of the second plug 112 held within the inner housing 252. The terminals 256 are terminated to ends of corresponding wires 108. For example, the terminals 256 may be crimped to the corresponding wires 108. The terminals 256 include sockets 310 at mating ends of such terminals 256. The sockets 310 receive corresponding second pins 144 of corresponding contacts 140. Optionally, the terminals 256 may be box-shaped terminals defining the sockets 310 with deflectable beams 312 that extend into the sockets 310 to electrically connect to the corresponding second pins 144. In an exemplary embodiment, distal ends 314 of the terminals 256 extend forward of the inner housing 252 and into corresponding pockets 316 of the ISL 260. Arms 318 at the front of the inner housing 252 engage the distal ends 314 of the terminal 256 to hold the terminals 256 relative to the housing 250. The fingers 264 of the ISL 260 extend through the inner housing 252 and are positioned behind portions of the terminals 256 to lock the terminals within the housing 250. The arms 318 define a primary lock for the terminals 256 and the fingers 264 define secondary locks for the terminals 256.

When the second plug 112 is plugged into the header 120, the shroud 258 of the outer housing 254 receives the second end 124 of the header 120. A portion of the header 120 is loaded into the outer housing 254 between the space defined between the outer housing 254 and the inner housing 252. The peripheral seal 270 engages the interior surface 220 of the body 130. The peripheral seal 270 seals the second plug 112 within the second receptacle 134. The peripheral seal 270 prevents moisture and contaminates from ingress into the second receptacle 134. A latch 320 of the header 120 engages the outer housing 254 to secure the second plug 112 within the second receptacle 134. The second plug 112 is prevented from backing out of the second receptacle 134 by the latch 320.

When the electrical connector assembly 100 is assembled, a sealed connection is provided between the wire harnesses 102, 104. The wires 106, 108 extend from opposite ends of the electrical connector assembly 100. Electrical paths are defined by the double ended contacts 140 between the terminals 156, 256. The contacts 140 have first and second mating interfaces 330, 332 both arranged interior of the body 130 of the header 120 for mating with the sockets 210, 310 of the first and second plugs 110, 112, respectively. The mating interfaces 330, 332 are separable such that the plugs 110, 112 may be removed from the header 120.

In an exemplary embodiment, some of the components of the first plug 110 may be identical to the corresponding components of the second plug 112. For example, both plugs 110, 112 may include identical inner housings 152, 252, identical terminals 156, 256, identical ISLs 160, 260, identical peripheral seals 170, 270, and/or identical wire seals 172, 272. Both plugs 110, 112 may have different outer housings 154, 254, such as to change the outer periphery of the plugs 110, 112 and/or to protect certain components of the plugs 110, 112. For example, the smaller outer housing 154 allows the one end of the electrical connector assembly to remain small or low profile for positioning such end in tight spaces and/or through small openings. For example, the larger outer housing 254 protects the peripheral seal 270 from damage by providing a shroud around the peripheral seal 270.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a header comprising a body having a first receptacle and a second receptacle separated by a midwall;

a plurality of contacts held by the midwall, the contacts having first pins located within the first receptacle and second pins located within the second receptacle;

a first plug received in the first receptacle, the first plug comprising a housing holding a plurality of terminals terminated to corresponding wires, the terminals having sockets mated with corresponding first pins in the first receptacle, the sockets being configured to be electrically connected to sockets of a second plug received in the second receptacle by the contacts held by the header, the first plug comprising an independent secondary lock and peripheral seal coupled to a mating end of the housing, the independent secondary lock having at least one finger engaging the terminals to hold the terminals in the housing, the peripheral seal engaging the body to seal the first plug within the first receptacle.

2. The electrical connector assembly of claim 1, wherein the header and contacts allow the first plug and corresponding sockets to mate with the second plug and corresponding sockets of the second plug.

3. The electrical connector assembly of claim 1, wherein the contacts have first and second mating interfaces both arranged interior of the body of the header, the first mating interfaces for mating with the sockets and the second mating interfaces configured for mating with second sockets of the second plug.

4. The electrical connector assembly of claim 1, wherein the header includes a first end and a second end, the first end being open to the first receptacle, the first plug being loaded into the first receptacle through the first end, the second end being open to the second receptacle, the second plug being loaded into the second receptacle through the second end.

5. The electrical connector assembly of claim 1, wherein the header comprises a first mating interface defined by the body and first pins and a second mating interface defined by the body and second pins, the first and second mating interfaces being identical.

6. The electrical connector assembly of claim 1, wherein the housing comprises an inner housing and an outer housing, the outer housing surrounding at least part of the inner housing, the outer housing being removably latched to the header.

7. The electrical connector assembly of claim 6, wherein the outer housing is positioned rearward of the peripheral seal.

8. The electrical connector assembly of claim 6, wherein the body defines a header envelope having a height and a width, the outer housing contained within the header envelope.

9. The electrical connector assembly of claim 1, further comprising a second plug, the second plug comprising an inner housing holding a plurality of second terminals terminated to corresponding wires, the second terminals having sockets configured to be mated with corresponding second pins in the second receptacle, the second plug comprising an independent secondary lock and peripheral seal coupled to a mating end of the inner housing of the second plug, the second plug comprising an outer housing surrounding at least part of the inner housing of the second plug, the outer housing being removably latched to the header, the inner housing of the second plug being identical to the inner housing of the first plug, the outer housing of the second plug including a shroud covering the periphery of the second plug, the shroud extending along an exterior of the body of the header, the outer housing of the first plug being un-shrouded.

10. An electrical connector assembly comprising:

a header comprising a body having a first receptacle and a second receptacle separated by a midwall, the header having a first latch extending from the body and a second latch extending from the body;

a plurality of contacts held by the midwall, the contacts having first pins located within the first receptacle and second pins located within the second receptacle;

a first plug received in the first receptacle, the first plug comprising a first housing holding a plurality of terminals terminated to corresponding wires, the terminals having sockets mated with corresponding first pins in the first receptacle, the first housing being coupled to the header and removably secured to the header by the first latch; and a second plug received in the second receptacle, the second plug comprising a second housing holding a plurality of terminals terminated to corresponding wires, the terminals having sockets mated with corresponding second pins in the second receptacle, the second housing being coupled to the header and removably secured to the header by the second latch.

11. The electrical connector assembly of claim 10, wherein the housing of the second plug includes a shroud extending along an exterior of the body of the header, the outer housing of the first plug being un-shrouded.

12. The electrical connector assembly of claim 10, wherein the header and contacts allow the first plug and corresponding sockets to mate with the second plug and corresponding sockets.

13. The electrical connector assembly of claim 10, wherein the contacts have first and second mating interfaces both arranged interior of the body of the header for mating with the sockets of the first and second plugs, respectively.

14. The electrical connector assembly of claim 10, wherein the header includes a first end and a second end, the first end being open to the first receptacle, the first plug being loaded into the first receptacle through the first end, the second end being open to the second receptacle, the second plug being loaded into the second receptacle through the second end.

15. The electrical connector assembly of claim 10, wherein the header comprises a first mating interface defined by the body and first pins and a second mating interface defined by the body and second pins, the first and second mating interfaces being identical.

16. The electrical connector assembly of claim 10, wherein the first plug comprises an independent secondary lock and peripheral seal coupled to a mating end of the housing of the first plug, the independent secondary lock having at least one finger engaging the terminals of the first plug to hold such terminals in the housing of the first plug, the peripheral seal engaging the body to seal the first plug within the first receptacle.

17. The electrical connector assembly of claim 10, wherein the housing of the first plug comprises an inner housing and an outer housing, the outer housing surrounding at least part of the inner housing, the outer housing being removably latched to the header.

18. The electrical connector assembly of claim 17, wherein the body defines a header envelope having a height and a width, the outer housing contained within the header envelope.

19. The electrical connector assembly of claim 17, wherein the housing of the second plug comprising an inner housing and an outer housing surrounding at least part of the inner housing, the inner housing of the second plug being identical to the inner housing of the first plug, the outer housing of the second plug including a shroud covering the periphery of the second plug, the shroud extending along an exterior of the body of the header, the outer housing of the first plug being un-shrouded.

* * * * *